US006125725A

United States Patent [19]

Fox et al.

[11] Patent Number: 6,125,725

[45] Date of Patent: Oct. 3, 2000

[54] DEVICE FOR ROTATING AT LEAST ONE ROTATABLE ELEMENT

[75] Inventors: Jeffrey Brian Fox; Jan Burger, both of Pretoria; Coenraad Jacobus Strydom, Centurion, all of South Africa

[73] Assignee: Scambia Industrial Developments Aktiengesellschaft, Schaan, Liechtenstein

[21] Appl. No.: 09/130,927

[22] Filed: Aug. 6, 1998

[30] Foreign Application Priority Data

Aug. 7, 1997 [ZA] South Africa ..... 97/7054

[51] Int. Cl.[7] ..... B25B 23/16

[52] U.S. Cl. ..... 81/177.8; 81/177.5

[58] Field of Search ..... 81/177.6, 177.7, 81/177.8; 7/100, 138

[56] References Cited

U.S. PATENT DOCUMENTS

| | | | |
|---|---|---|---|
| 1,542,336 | 6/1925 | Carlberg | 81/125.1 |
| 2,836,210 | 5/1958 | Garofalo . | |
| 3,526,160 | 9/1970 | Thurber . | |
| 4,558,848 | 12/1985 | Rutter . | |
| 4,607,406 | 8/1986 | Davis . | |
| 5,201,257 | 4/1993 | Engel . | |
| 5,590,575 | 1/1997 | Ludy | 81/177.5 |

FOREIGN PATENT DOCUMENTS

| | | | |
|---|---|---|---|
| 297210 | 9/1928 | United Kingdom | 81/177.6 |
| 1015570 | 1/1966 | United Kingdom . | |

*Primary Examiner*—Stephen F. Gerrity
*Assistant Examiner*—David B. Thomas
*Attorney, Agent, or Firm*—Brown & Wood, LLP

[57] ABSTRACT

The device for manually rotating at least one rotatable element, particularly an element of a jack, possesses a handle, a pivot and a coupling member. The handle has two arms. The handle and the pivot consist of a one-piece rod or of two rods which were initially separate and have then been rigidly and nondetachably connected at adjacent ends. The pivot penetrates the coupling member and connects the latter pivotably to the handle. The two arms have contacting portions which contact one another and are secured to one another by spot weld joints. One of the arms has an end portion shaped to serve for removing hub caps. The handle and pivot are manufactured from a straight rod or two straight rods having a circular cross-section by non-cutting shaping. The device can be manufactured and assembled quickly and at low costs and enables to transmit large torques.

14 Claims, 2 Drawing Sheets

DEVICE FOR ROTATING AT LEAST ONE ROTATABLE ELEMENT

BACKGROUND OF THE INVENTION

1. Field of the Invention

The invention relates to a device for rotating at least one rotatable element, particularly at least one of a rotatable element belonging to a jack, of a screw, of a bolt and of a nut, comprising an elongated handle, a pivot and a coupling member, the pivot penetrating the coupling member and connecting the latter pivotably to said handle and the coupling member having an end portion which is configured for detachably engaging with the rotatable element.

The device or assembly can particularly be utilized as a crank for manually rotating a rotatable element of a jack, such as the spindle of a scissors jack. The device and the jack can be carried together in a vehicle, e.g. a private motor car, and serve to raise and/or lower the vehicle. The device may in addition or instead be utilized as a wrench for rotating at least one rotatable element consisting of a screw, bolt and/or nut or the like, e.g. the screws or bolts or nuts serving for fastening the wheels of the vehicle. The handle of the device may further have an end portion configured for removing a hub cap of a wheel.

2. Description of the Prior Art

Devices known in practice for driving a spindle of a jack comprise three separate pieces, viz. an elongated handle being generally hollow and polygonal in cross-section, a socket being in cross-section hexagonal along its entire length and a pivot which penetrates transverse holes of the handle as well as of the socket and is riveted to a handle end portion. This handle end portion is broader than the main portion of the handle and open on one side so that the socket can be turned into the interior of said handle end portion.

These known devices have the drawbacks that it needs a lot of time and entails considerable costs to shape the handle, to provide the handle with a bore, to assemble the handle, socket and pivot and to rivet the latter to the handle. Moreover, the socket is cut off of a relatively expensive hexagonal pipe.

The U.S. Pat. No. 1,542,336 discloses among other a wrench having a socket and a fork-shaped handle. The handle is formed of a pair of flat bars which are united at a portion and spread part at an end to form fork prongs. The socket is rotatably mounted in the fork by means of a pin which penetrates the socket and bores of the two bars. This wrench has the drawbacks that the two bars must be provided with bores and that the pin must then be assembled and connected with the two bars. The socket has moreover a complicated shape. Thus, the manufacturing and assembling of this wrench entails considerable costs, too. This wrench is moreover not intended to be utilized as crank for rotating an element of a jack.

The U.S. Pat. No. 3,526,160 discloses a wrench having a socket and a generally U-shaped handle. The handle has two arms provided with inwardly extending, aligned end portions which penetrate bores of the socket and serve as pivots. The two arms are spaced from one another over the entire lengths thereof and the two end portions or pivots are also spaced from one another so that the two end portions may easily slide out of the bores and the handle is not suitable for transmitting large torques.

SUMMARY OF THE INVENTION

It is an object of the invention to overcome disadvantages of the known devices and, more specifically, to provide a device which can be manufactured and assembled quickly and at low costs and is suitable for transmitting large torques onto the coupling member.

The foregoing object and other objects are attained according the invention by providing a device for rotating at least one rotatable element, particularly at least one of a rotatable element belonging to a jack, of a screw, of a bolt and of a nut, comprising an elongated handle having two arms, a pivot which is circular in cross-section, and a coupling member, the pivot penetrating the coupling member and connecting the latter pivotably to said handle, the coupling member having an end portion which is configured for detachably engaging with the rotatable element, wherein the pivot comprises pivot portions each being continuous with one of the arms, wherein each arm has a contacting portion and wherein the contacting portions of the two arms contact one another a distance away from the pivot and are nondetachably secured to one another.

According to another aspect of the invention, there is provided a method for manufacturing a device for rotating at least one rotatable element, particularly at least one of a rotatable element belonging to a jack, of a screw, of a bolt and of a nut, comprising an elongated handle, a pivot and a coupling member, the pivot penetrating a transverse hole of the coupling member and connecting the latter pivotably to said handle and the coupling member having an end portion which is configured for detachably engaging with the rotatable element, wherein the handle has two arms each having a contacting portion, wherein the contacting portions of the two arms contact one another a distance away from the pivot, wherein the coupling member having a throughgoing transverse hole is provided, wherein each arm and at least a pivot portion are made from a one-piece rod which is initially circular in cross-section and straight and is bent and inserted into the transverse hole and wherein the contacting portions are secured to one another.

The oblong handle and the pivot can be formed by a single, one-piece rod or by two initially separate one-piece rods each forming an arm and a pivot portion. This makes it possible to manufacture the complete device or assembly exclusively from only two or three initially separate pieces. This simplifies in turn the manufacturing and particularly the assembling of the device, so that the device can be manufactured and assembled with few relatively simple working operations quickly and at low costs. The device is also solid and durable and allows to transmit a large torque from the handle onto the socket even when the arms and the pivot are relatively thin.

BRIEF DESCRIPTION OF THE DRAWINGS

Preferred embodiments of the invention are represented in the accompanying drawings. In the drawings, there show FIG. 1 a top view of a device having a handle and a pivotable socket, the latter being in a position in which the socket is in the space between the arms of the handle, FIG. 2 a side elevation of the device in the same state as in FIG. 1, FIG. 3 a view of the device from below, the socket being in a position in which it projects away from the handle, FIG. 4 a side elevation of the device in the same state as in FIG. 3, FIG. 5 a side elevation of a scissors jack and of the device according to the FIGS. 1 to 4 in separate positions and FIG. 6 a section of a part of another device.

DETAILED DESCRIPTION OF PREFERRED EMBODIMENTS

Figure 1:
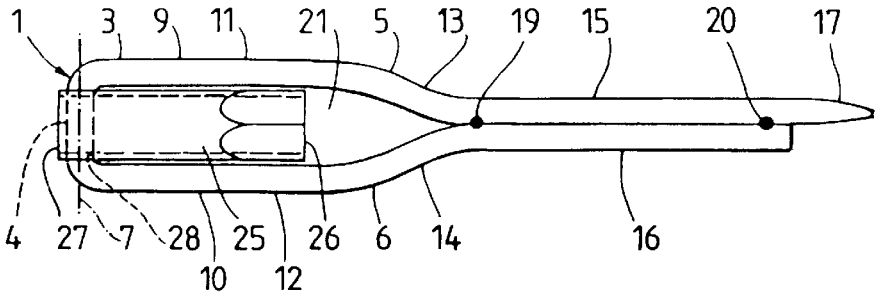

The multi-purpose device 1 or assembly shown in the FIGS. 1 to 4 comprises an elongated handle 3 and a pivot 4.

The handle and the pivot consist together of a one-piece rod of a ductile, metallic material, viz. steel. The rod has a full cross-section which is in the largest part of the length of the rod substantially circular. The handle 3 has a first, longer arm 5 and a second, shorter arm 6. The pivot 4 forms one of the ends of the handle, defines a swivelling axis 7, and has two opposite ends. The pivot 4 includes two pivot portions forming each a half of the pivot. Each of these pivot portions is contiguous and continuous at one end with one of the arms 5, 6 over the complete cross-sectional areas of the arms and of the pivot. The two pivot portions or pivot halves are of course also contiguous and continuous with one another over their complete cross-section. The two pivot portions are of course also rigidly and nondetachably connected with one another and with the two arms. The two arms 5, 6 have axes which are partly straight and partly curved and lie together with the swivelling axis 7 in a common plane. The two arms together define a longitudinal direction or longitudinal, straight middle axis of the oblong handle which is perpendicular to the pivot axis 7.

Each arm 5, 6 has an initial portion 9 and 10, respectively. Each initial portion 9 and 10 includes a substantially straight portion 11 and 12, respectively, which is adjacent to the pivot 4 and connected therewith by a curved transition. The substantially straight portions 11, 12 are perpendicular to the pivot 4 and parallel to one another. Each initial portion 9, 10 comprises further a transition portion 13 and 14 respectively. The transition portions 13, 14 are contiguous and continuous with those ends of the straight portions 11 and 12, respectively, which are remote from the pivot 4. The transition portions 13, 14 are at least partly curved and approach one another in a direction running away from the pivot. Each arm 5, 6 comprises further a contacting portion 15 and 16, respectively. Each contacting portion 15, 16 is contiguous and continuous with the associated transition portion 13 and 14, respectively. The contacting portions 15, 16 are substantially straight and parallel to the straight portions 11, 12 as well as parallel to one another. The contacting portions 15, 16 contact one another laterally a distance away from the pivot 4. The first, longer arm 15 has an end portion 17 which forms the free end of the arm remote from the pivot and projects away from the pivot over the second, shorter arm 6. The largest part of the rod forming the handle is, substantially circular in cross-section. More specifically, the pivot 4, the first, longer arm 5, except for the end portion 17, and the second, shorter arm 6 are substantially circular in cross-section. It is remarked with regard to the expression "substantially circular" that the cross-sectional shapes of the bent portions of the rod forming the handle may possibly slightly deviate from the ideal circular shape as a result of the deformation occurring during bending of the rod.

The end portion 17 of the first arm 5 is flattened and has two substantially plain surfaces opposite to one another. The two plain surfaces are both inclined towards the middle axis of the first arm so that they approach one another away from the pivot. The end portion 17 is thus tapering towards the free end of the first, longer arm 5 in the views represented in the FIGS. 1, 3 and in a longitudinal section through said plain surfaces. However, the free end of the end portion 17 is preferably not sharp-edged, but formed by a narrow end surface, which is curved in said axial section through the first arm and/or flat. In the side elevations shown in the FIGS. 2 and 4, the end portion 17 is at least partly broadening towards the free end thereof. The end portion 17 is therefore more or less wedge-shaped and/or similar to the end portion of a screw driver.

The contacting portions 15, 16 of the two arms 5, 6 are nondetachably, rigidly and solidly secured to one another by means of at least one weld joint, namely by two spot weld joints 19, 20. The two spot weld joints 19, 20 are spaced along the arms and are disposed near the two ends of the straight contacting portion 16 of the second, shorter arm 16. The initial portions 9, 10 of the two arms border an elongated space 21 which extends from the pivot 4 to the point where the transition portions 13, 14 of the two arms unite.

The device 1 or assembly also comprises a coupling member 25, viz. a socket 25 consisting of a straight one-piece tube of a ductile, metallic material, e.g. steel. The socket has a longitudinal axis and a jacket bounding a throughgoing, longitudinal hole. The socket is accordingly open at both ends and has a first socket end portion 26 and an opposite second socket end portion 27. The first socket end portion 26 is substantially polygonal, namely hexagonal in cross-section. The substantially hexagonal first socket end portion 26 is connected by a short transition with the remaining socket part which is circular in cross-section. Accordingly, the second end portion 27 is circular in cross-section, too.

The cross-sectional dimensions of the socket, viz. the maximum and minimum cross-sectional dimensions of the hexagonal end portion 26 and the diameter of the remaining part of the socket, are substantially bigger than the diameter of the rod forming the handle 3. The rod serving to form the handle 3 has for instance a diameter of about 8 mm to 12 mm. The cross-sectional dimension measured between two opposite plain outer surfaces of the hexagonal, first socket end portion 26 is preferably at least two times larger than the diameter of the rod, e.g. about 25 mm to 30 mm.

The second end portion 27 is provided near its free end with a throughgoing, transverse hole 28. This hole 28 is diametrical to the socket, intersects the longitudinal hole and axis of the socket perpendicularly and consists of two cylindrical, transverse bores which are disposed in diametrically opposite jacket portions of the socket 25 and aligned with one another. The pivot 4 penetrates the hole 28 of the socket 25 and has two already mentioned pivot portions each penetrating and supporting one of the two aligned bores forming the transverse hole 28 with little radial play. Therefore, the socket can be turned around the pivot 4 and the swivelling axis 7 with respect to the handle.

Figure 2:
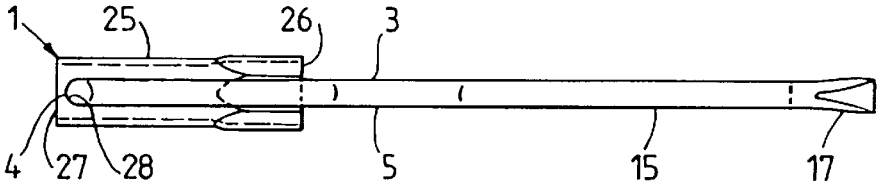
Figure 3:
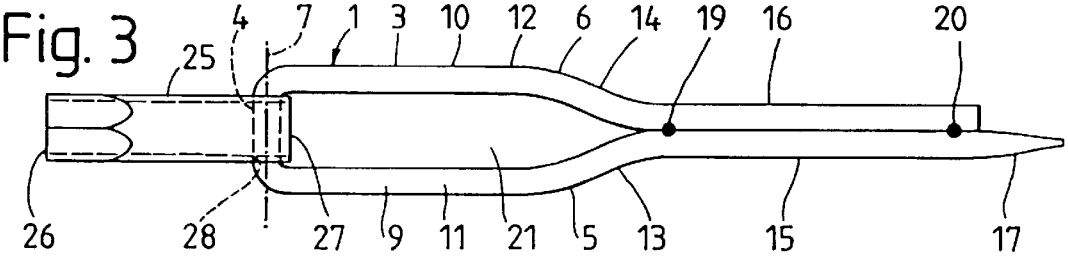
Figure 4:
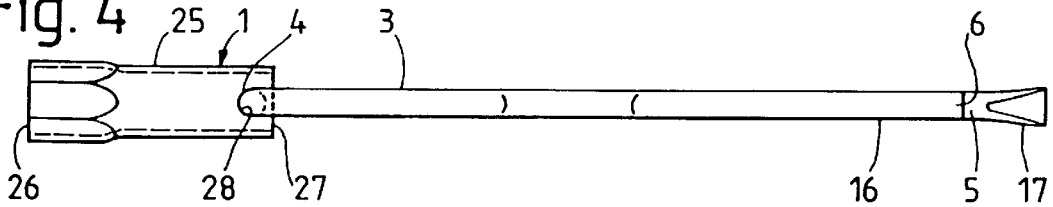

The socket 25 can for instance be turned into the rest position shown in the FIGS. 1 and 2. The largest longitudinal part of the socket and particularly the first socket end portion 26 is then disposed between the initial portions 9, 10 of the two arms 5, 6 in the view shown in FIG. 1, viz. in a perpendicular projection onto the plane running through the swivelling axis 7 and the axes of the two arms. The largest part of the socket or—more precisely—the middle cross-sectional zone of the largest longitudinal part of the socket is then disposed within the space 21, whereas the upper and lower cross-sectional zones project out of the space 21 as can be seen in FIG. 2. The socket has in the rest position some play between the two arms in a direction parallel to the axis 7. However, the substantially straight portions 11, 12 of the arms may possibly be provided with a little bulge or the like projecting into the space 21 and towards the opposite arm and making it possible to pinch the socket slightly and detachably in the rest position. The socket can—starting from the rest position—be turned around the pivot into various positions where the major part of the socket is outside the space 21, e.g. in the position shown in the FIGS. 3 and 4.

Figure 5:
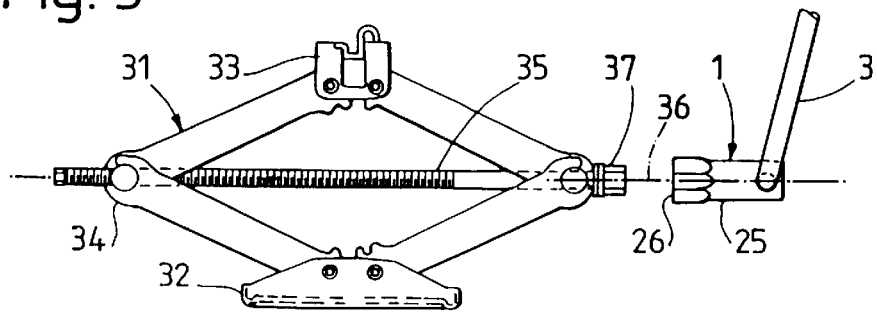

The scissors jack 31 shown in FIG. 5 comprises a support 32 which can rest on a plain, horizontal supporting surface of a ground or the like. The jack 31 comprises further a load carrier 33 which is for instance configured to support and engage a part of a private motor car. A transferring mechanism 34 connects the load carrier 33 vertically adjustably to the support 32. The mechanism 34 includes a rotatable element 35 having a threaded spindle rotatable about an approximately horizontal axis 36. The mechanism 34 is configured in such a manner that the height of the load carrier can be varied by rotating the element 35. An adapter element 37 is rigidly secured to one of the ends of the spindle and has a head portion which is polygonal, namely hexagonal, in cross-section and fits into the first hexagonal socket end portion 26.

The multi-purpose device 1 is shown in FIG. 5, too, and can be used as a crank for manually rotating the rotatable element 35 of the jack 31. For this purpose, the socket 25 is turned out of the space 21 of the handle 3. The hexagonal first socket end portion 26 is then pushed parallel to the axis 36 onto the adapter 37 of the jack so that the axis of the socket coincides with the axis 36 of the spindle. A person can now seize the handle 3 with a hand, turn the handle about the swivelling axis 7 into a position in which the longitudinal middle axis of the handle forms an angle with the axis of the socket. The person can then manually rotate the rotatable element 35 by means of the device 1 and thereby raise and/or lower the load carrier 33 of the jack.

When the utilization of the jack is terminated, the device is removed from the adapter 37 of the jack. The socket can then be turned into the rest position, viz. into the space 21. The device can afterwards for instance be stowed in the motor car and will occupy only a small space.

The device may possibly also be used for rotating screws and/or bolts and/or nuts fitting into the hexagonal, first socket end portion 26. The socket may particularly serve for loosening and tightening screws or bolts or nuts provided to fasten the wheels of the car.

The device 1 can also be used for removing a hub cap of a wheel of the motor car. For this utilization of the device, a person may seize the handle 3 and insert the tapering end portion 17 of the first arm 5 at the edge of the hub cap between the latter and the remaining part of the wheel and thereby loosen the hub cap.

Next, a method for manufacturing the device 1 is described. The socket 25 is produced starting from a long tube having a circular cross-section. A piece of the tube having the desired length of the socket may be cut off. An end portion of this tube piece or socket is then shaped by non-cutting shaping, e.g. pressing, so as to form the hexagonal, first socket end portion 26. The socket is further provided with the hole 28, for instance by drilling.

The handle 3 is produced starting from a long rod having a circular cross-section. From this long rod, a shorter, straight rod having the length needed for forming the handle is cut off. The cut off rod is then inserted, for instance in straight, undeformed state, into and through the transverse hole 28 of the socket 25 so that a rod portion designated to form the pivot 4 is disposed within the socket and the rod portions designated to form the two arms 5, 6 project out of the socket on opposite sides thereof. The rod is then bent into the desired shape of the handle. The contacting portions 15, 16 of the two arms are afterwards pressed against one another and secured to one another by spot welding. In addition, the free end portion of the first longer arm 5 is brought by non-cutting shaping, e.g. pressing, into the described shape of the end portion 17. Thus, the handle including the pivot can be produced from a straight rod having the appropriate length exclusively by non-cutting shaping, viz. bending and pressing.

The sequence of working steps may of course be varied in various ways. For instance the socket can be provided with the hole 28 before the first socket end portion 26 is brought into a hexagonal shape. The hexagonal shaping and/or the drilling of the hole may possibly even take place before the socket is cut off from a long tube.

The sequence of steps for shaping the handle 3 and for connecting the latter with the socket may also be varied. For instance one of the arms 5, 6 may be bent and/or the end portion 17 of the first arm 5 shaped before the rod is inserted into the hole 28 of the socket.

The version of the multi-purpose device 1 partly represented in FIG. 6 comprises again an elongated handle 3, a pivot 4 and a coupling member 25, i.e. a socket 25. The handle 3 and the pivot 4 of this version are made from a first one-piece rod 51 and a second one-piece rod 52 which were initially separate. The socket 25 is configured identical as the one described with reference to the FIGS. 1 to 5 and has particularly a jacket which bounds a throughgoing, longitudinal hole and is provided with a throughgoing transverse hole 28. The latter is again formed by two cylindrical, transverse bores which are arranged in diametrically opposite jacket portions and aligned with one another.

The first rod 51 forms the first arm 5 of the handle and a first pivot portion 53. The second rod 52 forms the second arm 6 of the handle and a second pivot portion 54. The two arms 5, 6 are about the same as those described with reference to the FIGS. 1 to 4. Each arm 5, 6 has particularly an initial portion 9, 10 with a straight portion 11, 12 which is contiguous and continuous over a curved transition with the pivot portion 53, 54 respectively. The two arms have also contact portions 15, 16 connected rigidly and nondetachably by at least two spot weld joints of which only the weld joint 19 can be seen in FIG. 6. The first arm 3 may also again be longer than the second arm 6 and have at the not-shown, free end an end portion which is the same as the end portion 17 shown in the FIGS. 1 to 4. The two rods 51, 52 are substantially—viz. except to the last mentioned end portion and minor local changes of the cross-sectional shapes resulting from bending—circular in cross-sections and have the same diameters.

The two pivot portions 53, 54 are substantially straight and aligned with one another. Each pivot portion 53, 54 penetrates one of the two transverse bores forming together the transverse hole 28. The two pivot portions 53, 54 have end surfaces at their ends further away from the arms 5, 6. These end surfaces are at least partially flat, parallel to one another and perpendicular to the swivelling axis 7 and may have have inclined edge portions forming together a V-shaped groove for welding. The pivot portion ends which are further away from the arms and were initially separated are rigidly and nondetachably connected by a weld joint 55. The weld joint 55 is disposed on a circumferential section of the pivot portions 53, 54 namely for instance on that circumferential section which is closest to the free end of the second socket end portion 27 when the socket is in the rest position shown in FIG. 6. It may be noted that the two pivot portions 53, 54 could be connected by two or more weld joints disposed at different circumferential places or by a weld joint encircling the pivot portions all around their circumferences. The unwelded section of the ends of the two pivot portions 83, 83 are for instance separated by a small gap as shown in FIG. 6, but could instead rest one against the other without gap.

Figure 6:
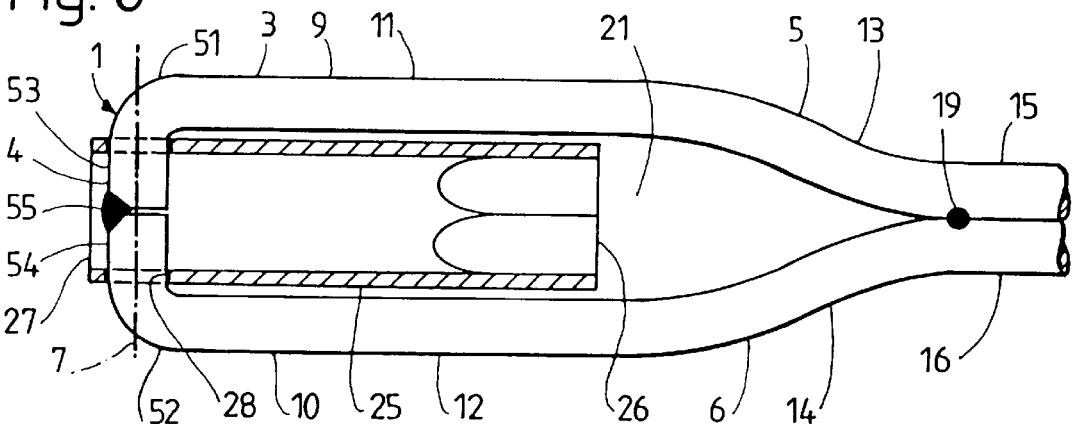

For manufacturing the device shown in FIG. 6, straight rods having a circular cross-section and the lengths of the rods 51 and 52 may be cut off from a longer rod. These two straight rods are then bent to the shapes shown in FIG. 6 and a free end portion of the first, longer arm is brought by pressing and/or another non-cutting shaping operation into the desired shape of the end portion 17. The socket 25 is produced in the same way as described for the first embodiment. The pivot portions 53, 54 of the two bent rods 51, 52 are inserted into the transverse bores of the socket 25, wherein the latter is brought into the rest position shown in FIG. 6. The socket 25 and the rods 51, 52 are then arranged in a holding and pressing device which holds the two rods in the desired position with respect to one another and to the socket. The holding and pressing device presses moreover the contact portions 15, 16 and possibly also the pivot portions 53, 54 of the two rods 51, 52 against one another. The two rods are then secured to one another by forming the weld joint 19, the weld joint 20 not shown in FIG. 6 and the weld joint 55. The weld joint 55 may be produced for instance by introducing a flame produced by a welding torch and welding material or a consumable welding electrode through the opening at the second socket end portion 27.

As far as nothing else has been written above, the device represented in FIG. 6 as well as the manufacturing and the use thereof are the same or similar as in case of the device described with reference to the FIGS. 1 to 5. The two devices and the manufacturing method thereof give also to a large part the same or similar advantages. It is pointed out that that the handles and the sockets of both embodiments can be manufactured and assembled at low costs.

The device and the manufacturing thereof may possibly be modified in other manners. The contacting portions 15, 16 of the two arms might for instance be connected by more than two spot weld joints. The spot weld joints might also be replaced by one elongated weld joint, i.e. a weld seam. The weld joints 19. 20 and/or the weld joint 55 might possibly even be replaced by at least one brazing or soldering or gluing joint.

The scissors jack may be replaced by another type of jack having a rotatable element for raising and lowering the load carrier of the jack. The jack may then comprise for instance a driving element which is rotatable about an inclined axis and connected by a pair of bevel gearwheels with a vertical thread member, e.g. spindle. The rotatable driving element of the jack can also comprise an adapter. This adapter can be configured for instance similar to the adapter 37 shown in FIG. 5 so that the socket 35 can engage with this adapter. However, the adapter of the jack might also be configured otherwise. The device according to the invention may then have, instead of a socket, a different coupling member configured for coupling the coupling member detachably and rotationally rigidly with the adapter of the rotatable element. The adapter of the rotatable element may have for instance an axial, polygonal, e.g. hexagonal pocket hole similarly to a hexagon socket screw. The coupling member may then comprise for instance a pin having an end portion which is hexagonal in cross-section and fits into the hexagon pocket hole of the adapter of the rotatable element of the jack.

What is claimed is:

1. A device for rotating at least one rotatable element, particularly at least one of a rotatable element belonging to a jack, of a screw, of a bolt and of a nut, comprising an elongated handle having two arms, a pivot and a coupling member, the pivot penetrating the coupling member and connecting the latter pivotably to said handle, the coupling member having an end portion which is configured for detachably engaging with the rotatable element, wherein the pivot comprises pivot portions each being continuous with one of the arms, wherein each arm has a contacting portion and wherein the contacting portions of the two arms contact one another a distance away from the pivot and are secured to one another, wherein one of a one-piece rod are formed by the complete pivot and the two arms and of two initially separate one-piece rods which form each one of the arms and one of said pivot portions and are nondetachably and rigidly connected with one another at adjacent ends of the pivot portions.

2. A device as claimed in claim 1, wherein the contacting portions of the arms rest laterally against one another and are nondetachably secured to one another.

3. A device as claimed in claim 1, wherein the contacting portions of the arms rest laterally against one another and are secured to one another by one of welding, brazing, soldering and gluing.

4. A device as claimed in claim 1, wherein the contacting portions of the arms rest laterally against one another over a longitudinal part of the arms and are secured to one another by at least two spot weld joints spaced from one another along the arms.

5. A device as claimed in claim 1, wherein the coupling member has a jacket comprising two bores disposed in opposite jacket portions of the coupling member and aligned with one another, wherein each of said pivot portion penetrates one of the bores and wherein the pivot portions formed by the two rods are connected to one another by one of welding, brazing, soldering and gluing between the two bores.

6. A device for rotating a rotatable element belonging to a jack, comprising an elongated handle having two arms, a pivot and a coupling member, the pivot penetrating the coupling member and connecting the latter pivotably to said handle, the coupling member having an end portion which is configured for detachably engaging with the rotatable element, wherein each arm has a contacting portion, wherein the contacting portions of the two arms contact one another a distance away from the pivot and are secured to one another and wherein the handle and the pivot consist of one of a one-piece rod which forms the two arms and the pivot and of two initially separate rods each of which forms one of the arms and a pivot portion being connected rigidly and nondetachably to the pivot portion formed by the respective other rod.

7. A device as claimed in claim 6, wherein the coupling member has a jacket comprising two aligned bores disposed in opposite jacket positions, wherein the pivot portion of each of said rods penetrates one of the bores and wherein the two pivot portion, are connected to one another by one of welding, brazing, soldering and gluing between the two bores.

8. A device as claimed in claim 6, wherein the contacting portions of the arms are secured to one another by at least two spot weld joints spaced from one another along the arms.

9. A device as claimed in claim 6, wherein the contacting portions of the two arms are substantially straight and parallel to one another, wherein each arm comprises an initial portion disposed between the pivot the contacting portions and wherein the intermediate portions define a space which is configured so that the coupling member can be pivoted into a rest position in which at least a cross-sectional zone of said end portion of the coupling member is located within said space.

10. A device as claimed in claim 6, wherein at least the largest parts of the two arms are substantially circular in cross-section and wherein one of said arms is longer than the other and has an end portion which is remote from the pivot, projects over the other arm and is provided with the two surfaces opposite to one another and approaching one another away from the pivot.

11. A device for rotating at least one rotatable element, particularly at least one of a rotatable element belonging to a jack, of a screw, of a bolt, and of a nut, comprising an elongated handle having two arms, a pivot and a coupling member, the pivot penetrating the coupling member and connecting the latter pivotably to said handle, the coupling member and end portion which is configured for detachably engaging with the rotatable element, wherein the pivot comprises pivot portions each being continuous with one of the arms, wherein each arm has a contacting portion and wherein the contacting portions of the two arms contact one another a distance away form the pivot and are secured to one another, wherein the pivot penetrates the coupling member near an end opposite said end portion of the coupling member, wherein the contacting portions of the two arms are substantially straight and parallel to one another, wherein each arm comprises an initial portion disposed between the pivot and the contacting portions, and wherein the initial portions define a space which is configured so that the coupling member can be pivoted into a rest position in which at least a cross-sectional zone of the largest part of the longitudinal extension of the coupling member is located within said space.

12. A device for rotating at least one rotatable element, particularly at least one of a rotatable element belonging to a jack, of a screw, of a bolt and of a nut, comprising an elongated handle having two arms, a pivot and a coupling member, the pivot penetrating the coupling member and connecting the latter pivotably to said handle, the coupling member having an end portion which is configured for detachably engaging with the rotatable element, wherein the pivot comprises pivot portions each being continuous with one of the arms, wherein each arm has a contacting portion and wherein the contacting portions of the two arms contact one another a distance away from the pivot and are secured to one another, wherein said pivot portions are rigidly and nondetachably connected with one another, wherein at least the largest parts of the two arms and the pivot have full, substantially circular cross-sections, and wherein the arms are continuous with said pivot portions over their complete cross-sectional areas at opposite ends of the pivot.

13. A device for rotating at least one rotatable element, particularly at least one of a rotatable element belonging to a jack, of a screw, of a bolt and of a nut, comprising an elongated handle having two arms, a pivot and a coupling member, and the pivot penetrating the coupling member and connecting the latter pivotably to said handle, the coupling member having an end portion which is configured for detachably engaging with the rotatable element, wherein the pivot comprises pivot portions each being continuous with one of the arms, wherein each arm has a contacting portion and wherein the contacting portions of the two arms contact one another a distance away form the pivot and are secured to one another, wherein one of said arms is longer that the other and has an end portion which is remote form the pivot, projects over the other arm, and is provided with two surfaces opposite to one another and approaching one another away from the pivot.

14. A device for rotating at least one rotatable element, particularly at least one of a rotatable element belonging to a jack, of a screw, of a bolt and of a nut, comprising an elongated handle having two arms, a pivot and a coupling member, the pivot penetrating the coupling member and connecting the latter pivotably to said handle, the coupling member having an end portion which is configured for detachably engaging with the rotatable element, wherein the pivot comprises pivot portions each being continuous with one of the arms, wherein each arm has a contacting portion and wherein the contacting portions of the two arms contact one another a distance away form the pivot and are secured to one another, wherein the coupling member consists of a socket having a throughgoing longitudinal hole, wherein said end portion of the coupling member is polygonal in cross-section, and wherein the socket has, opposite said end portion, another end portion which is substantially circular in cross-section.

* * * * *